US009030454B2

(12) United States Patent
Lee et al.

(10) Patent No.: US 9,030,454 B2
(45) Date of Patent: May 12, 2015

(54) DISPLAY DEVICE INCLUDING PIXELS AND METHOD FOR DRIVING THE SAME

(75) Inventors: Hong-Woo Lee, Asan-si (KR); Ju Hyeon Baek, Asan-si (KR); Jae Min Seong, Asan-si (KR); Jong Hwan Lee, Anyang-si (KR)

(73) Assignee: Samsung Display Co., Ltd., Yongin (KR)

( * ) Notice: Subject to any disclaimer, the term of this patent is extended or adjusted under 35 U.S.C. 154(b) by 225 days.

(21) Appl. No.: 13/431,909

(22) Filed: Mar. 27, 2012

(65) Prior Publication Data

US 2013/0100102 A1 Apr. 25, 2013

(30) Foreign Application Priority Data

Oct. 24, 2011 (KR) ..... 10-2011-0108700

(51) Int. Cl.
*G09G 5/00* (2006.01)
*G09G 3/36* (2006.01)

(52) U.S. Cl.
CPC ..... *G09G 3/3677* (2013.01); *G09G 3/3614* (2013.01); *G09G 2310/0213* (2013.01)

(58) Field of Classification Search
CPC ..... G09G 3/3614; G09G 2310/0254
USPC ..... 345/209
See application file for complete search history.

(56) References Cited

U.S. PATENT DOCUMENTS 5,898,414 A * 4/1999 Awamoto et al. ..... 345/55
6,903,709 B2 * 6/2005 Kawasaki et al. ..... 345/60
6,929,392 B2 8/2005 Kim et al.
6,970,153 B2 11/2005 Park
7,121,710 B2 10/2006 Kim et al.
7,133,018 B2 11/2006 Kim et al.
7,327,344 B2 2/2008 Asada et al.
7,477,224 B2 1/2009 Song et al.
7,515,132 B2 4/2009 Kim et al.
7,589,462 B2 9/2009 Kim et al.
7,710,377 B2 5/2010 Kang et al.
7,733,838 B2 6/2010 Kwon et al.
7,884,782 B2 2/2011 Lee et al.
2001/0000662 A1 * 5/2001 Hashimoto et al. ..... 345/96
2001/0013852 A1 * 8/2001 Matsushima et al. ..... 345/92
2002/0005846 A1 * 1/2002 Hiroki et al. ..... 345/204
2003/0058229 A1 * 3/2003 Kawabe et al. ..... 345/204

(Continued)

FOREIGN PATENT DOCUMENTS

JP 2005-338463 12/2005
JP 2008-052244 3/2008

(Continued)

*Primary Examiner* — Claire X Pappas
*Assistant Examiner* — Robert Stone
(74) *Attorney, Agent, or Firm* — H.C. Park & Associates, PLC

(57) ABSTRACT

A display device includes an insulation substrate; a plurality of gate lines arranged on the insulation substrate in a first direction and including first group of gate lines and second group of gate lines; a plurality of data lines insulated from and crossing the plurality of gate lines; a gate driver applying gate-on voltages to the plurality of gate lines; and a data driver applying data voltages to the plurality of data lines, wherein at least one of the first group of gate lines is arranged between the second group of gate lines and the gate driver applies the gate-on voltages to the first group of gate lines during the first half of a frame and the gate-on voltages to the second group of gate lines during the second half of the frame.

2 Claims, 8 Drawing Sheets

(56) References Cited

U.S. PATENT DOCUMENTS

| | | | | |
|---|---|---|---|---|
| 2003/0067430 | A1 | 4/2003 | Kim | |
| 2004/0183768 | A1* | 9/2004 | Yamato et al. | 345/98 |
| 2004/0239602 | A1* | 12/2004 | Kim et al. | 345/87 |
| 2005/0174310 | A1* | 8/2005 | Huang et al. | 345/87 |
| 2006/0114207 | A1* | 6/2006 | Lee et al. | 345/89 |
| 2006/0164379 | A1 | 7/2006 | Oh et al. | |
| 2007/0001964 | A1* | 1/2007 | Lee et al. | 345/96 |
| 2007/0176868 | A1 | 8/2007 | Lee et al. | |
| 2007/0229432 | A1* | 10/2007 | Kimura | 345/96 |
| 2008/0062113 | A1 | 3/2008 | Kim | |
| 2008/0068516 | A1* | 3/2008 | Mori et al. | 348/790 |
| 2008/0218652 | A1 | 9/2008 | Kim et al. | |
| 2009/0040244 | A1* | 2/2009 | Lee et al. | 345/690 |
| 2009/0174638 | A1 | 7/2009 | Brown Elliott et al. | |
| 2009/0256833 | A1* | 10/2009 | Huang et al. | 345/213 |
| 2009/0289932 | A1* | 11/2009 | Nishi | 345/212 |
| 2010/0053059 | A1 | 3/2010 | Kim et al. | |
| 2010/0097366 | A1* | 4/2010 | Kitayama et al. | 345/213 |
| 2010/0277463 | A1* | 11/2010 | Yen et al. | 345/213 |
| 2010/0315402 | A1 | 12/2010 | Hashimoto | |
| 2011/0025589 | A1* | 2/2011 | Ooishi | 345/98 |
| 2011/0138208 | A1 | 6/2011 | Lee et al. | |
| 2011/0187682 | A1* | 8/2011 | Kim et al. | 345/204 |

FOREIGN PATENT DOCUMENTS

| | | |
|---|---|---|
| JP | 2008-298913 | 12/2008 |
| KR | 10-2005-0066720 | 6/2005 |
| KR | 10-2008-0000916 | 1/2008 |
| KR | 100898789 | 5/2009 |
| KR | 100909048 | 7/2009 |
| KR | 100965587 | 6/2010 |

* cited by examiner

DISPLAY DEVICE INCLUDING PIXELS AND METHOD FOR DRIVING THE SAME

CROSS-REFERENCE TO RELATED APPLICATION

This application claims priority from and the benefit of Korean Patent Application No. 10-2011-0108700, filed on Oct. 24, 2011, which is hereby incorporated by reference for all purposes as if fully set forth herein.

BACKGROUND OF THE INVENTION

1. Field of the Invention

Exemplary embodiments of the present invention relate to a display device, and more particularly, to a display device which may have improved power consumption.

2. Discussion of the Background

A display device may be used in a computer monitor, a television, a mobile phone, and the like. Examples of the display device include a cathode ray tube display device, a liquid crystal display, and a plasma display device.

In general, a display device may include a graphic processing unit (GPU), a display panel, and a signal controller. The graphic processing unit is configured to transmit image data of a screen to be displayed on the display panel to the signal controller, and the signal controller is configured to generate a control signal for driving the display panel to transmit the control signal together with the image data to the display panel, thereby driving the display device.

Tablet portable computers ("PC") and smart phones are opening new markets for display devices. The tablet PC and the smart phone require reduced power consumption due to the characteristics of portable devices.

One of the methods for reducing power consumption in a display device is to minimize a change in the polarity of the data voltage, and an example thereof is a column inversion driving method. However, a general column inversion driving method may cause image quality degradation such as a visible vertical line stain.

The above information disclosed in this Background section is only for enhancement of understanding of the background of the invention and therefore it may contain information that does not form the prior art.

SUMMARY OF THE INVENTION

Exemplary embodiments of the present invention provide a display device that may have reduced power consumption without causing image quality degradation.

Additional features of the invention will be set forth in the description which follows, and in part will be apparent from the description, or may be learned by practice of the invention.

An exemplary embodiment of the present invention discloses a display device, including: an insulation substrate; a plurality of gate lines arranged on the insulation substrate in a first direction and including a first group of gate lines and a second group of gate lines; a plurality of data lines insulated from and crossing the plurality of gate lines; a gate driver configured to apply a gate-on voltage to the plurality of gate lines; and a data driver configured to apply a data voltage to the plurality of data lines, wherein at least one of the gates lines of the first group of gate lines is arranged between the gates lines of the second group of gate lines and the gate driver is configured to apply the gate-on voltages to the first group of gate lines during the first half of a frame and the gate-on voltages to the second group of gate lines during the second half of the frame.

An exemplary embodiment of the present invention also discloses a display device, including: an insulation substrate; a plurality of gate lines arranged on the insulation substrate in a first direction; a plurality of data lines insulated from and crossing the plurality of gate lines; a gate driver configured to apply a gate-on voltage to the plurality of gate lines; and a data driver configured to apply a data voltage to the plurality of data lines, wherein the data driver is configured to invert the data voltage for every period longer than or equal to three or more horizontal periods and shorter than one frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
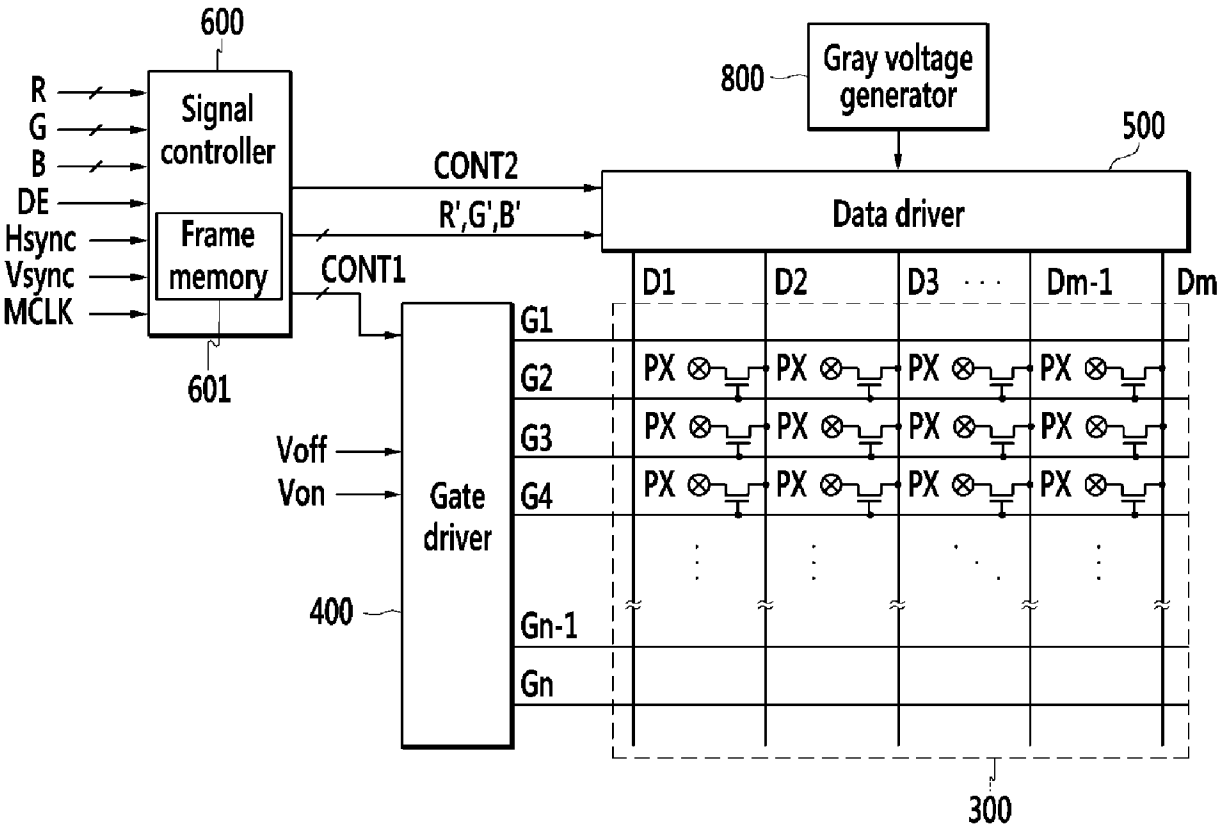
FIG. 1 is a block diagram of a display device according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

A display device according to an exemplary embodiment of the present invention will be described with reference to the accompanying drawings. The present invention may be applied to various display devices including a liquid crystal display, an organic light emitting diode display, and the like. Hereinafter exemplary embodiments of the present inventions will be described with reference to a liquid crystal display, but the present invention is not limited thereto.

Figure 2:
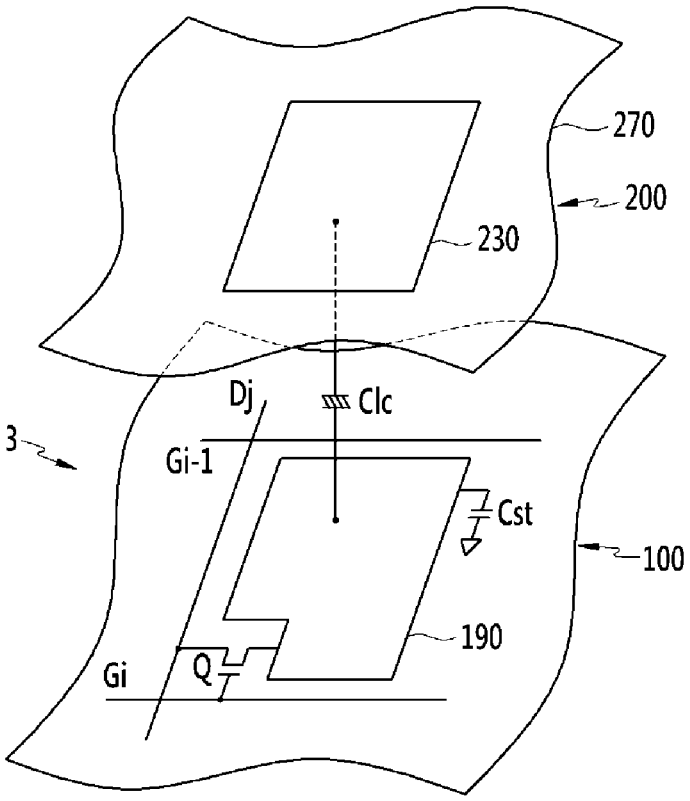
FIG. 2 is a circuit diagram of a pixel according to an exemplary embodiment of the present invention.

FIG. 1 is a block diagram of a display device according to an exemplary embodiment of the present invention and FIG. 2 is a circuit diagram of a pixel according to an exemplary embodiment of the present invention.

Referring to FIG. 1, a liquid crystal display according to an exemplary embodiment of the present invention includes a liquid crystal panel assembly 300, a gate driver 400 connected thereto, a data driver 500, a gray voltage generator 800 connected to the data driver 500, and a signal controller 600 controlling them. The signal controller 600 may include a frame memory 601 to temporarily store image signals input in sequence and to change an order of the image signals.

The liquid crystal panel assembly 300 includes a plurality of display signal lines $G_1$-$G_n$ and $D_1$-$D_m$ and a plurality of pixels PX connected thereto and arranged in a substantially matrix form when viewed in an equivalent circuit.

The display signal lines $G_1$-$G_n$ and $D_1$-$D_m$ include a plurality of gate lines $G_1$-$G_n$ to transfer gate signals (also, referred to as "scanning signals") and data lines $D_1$-$D_m$ to transfer data signals. The gate lines $G_1$-$G_n$ extend in a substantially horizontal direction and are substantially parallel to each other and the data lines $D_1$-$D_m$ extend in a substantially vertical direction and are substantially parallel to each other.

Referring to FIG. 2, each pixel includes a switching element Q connected to the display signal lines $G_1$-$G_n$ and $D_1$-$D_m$, and a liquid crystal capacitor $C_{lc}$. The pixel may also optionally include a storage capacitor $C_{st}$.

The switching element Q may be arranged on a lower panel 100 and may be a three terminal element in which a control terminal may be connected to the gate lines $G_1$-$G_n$, an input terminal may be connected to the data lines $D_1$-$D_m$, and an output terminal is connected to the liquid crystal capacitor $C_{lc}$ and the storage capacitor $C_{st}$.

The liquid crystal capacitor $C_{lc}$ includes two terminals: a pixel electrode 190 arranged on the lower panel 100 and a common electrode 270 arranged on an upper panel 200, and a dielectric material: a liquid crystal layer 3 arranged between the pixel electrode 190 and the common electrode 270. The pixel electrode 190 may be connected to the switching element Q. The common electrode 270 may be arranged over the whole surface of the upper panel 200 and may receive common voltage $V_{com}$. Alternatively, the common electrode 270 may be arranged on the lower panel 100 such that both the pixel electrode 190 and the common electrode 270 have a substantially linear or rod shape.

The storage capacitor $C_{st}$ may be arranged by overlapping a separate signal line (not shown) and the pixel electrode 190 in the lower panel 100 and by applying a reference voltage such as the common voltage $V_{com}$ to the separate signal line. The storage capacitor $C_{st}$ may also be formed by overlapping the pixel electrode 190 with a gate line, such as a previous gate line, with an insulator interposed therebetween.

In order to implement a color display, each of the pixels may be capable of displaying a color. This may be implemented by including a color filter 230 of red, green, or blue in a region corresponding to the pixel electrode 190. In FIG. 2, the color filter 230 is depicted in a region of the upper panel 200, but the color filter 230 may alternatively be arranged on or beneath the pixel electrode 190 of the lower panel 100.

A polarizer (not shown) configured to polarize light is attached to an outer surface of at least one of the lower panel 100 and the upper panel 200 of the liquid crystal panel assembly 300.

The gray voltage generator 800 may generate two sets of gray voltages related to transmittance of the pixel. One of the two sets has a positive value with respect to the common voltage $V_{com}$ and the other set has a negative value.

The gate driver 400 may be arranged on the left side of the liquid crystal panel assembly 300 and may be connected to the gate lines $G_1$-$G_n$ to apply a gate signal configured by a combination of gate-on voltage $V_{on}$ and gate-off voltage $V_{off}$ to the gate lines $G_1$-$G_n$. The gate driver 400 classifies the gate lines $G_1$-$G_n$ into a first group of gate lines $G_1$, $G_3$, $G_4$, $G_7$, $G_8$ . . . and a second group of gate lines $G_2$, $G_5$, $G_6$, $G_9$, $G_{10}$ . . . . The gate driver 400 may sequentially apply a gate-on voltages $V_{on}$ to the first group of gate lines $G_1$, $G_3$, $G_4$, $G_7$, $G_8$ . . . during the first half of a frame, and may sequentially apply the gate-on voltages $V_{on}$ to the second group of gate lines $G_2$, $G_5$, $G_6$, $G_9$, $G_{10}$ . . . during the second half of the frame.

The data driver 500 may be connected to the data lines $D_1$-$D_m$ of the liquid crystal panel assembly 300. The data driver 500 may select a corresponding gray voltage from the two sets of gray voltages generated by the gray voltage generator 800 and apply the selected gray voltage as a data voltage to a pixel. The data driver 500 may be a plurality of integrated circuits (ICs). The data driver 500 may generate data voltage Data 1 and data voltage Data 2 which swing between positive and negative values while having opposite polarities with respect to the common voltage $V_{com}$. The data voltage Data 1 may be applied to the odd numbered data lines and the data voltage Data 2 may be applied to the even numbered data lines. The data voltage applied to each of the data lines $D_1$-$D_m$ may be selected so that a polarity of the data voltage is changed every half frame.

The signal controller 600 may be configured to generate a control signal to control operations of the gate driver 400, the data driver 500, etc. The signal controller 600 may supply a control signal to the gate driver 400 and the data driver 500. The signal controller 600 may supply two scanning start signals, scanning start signal STVP1 and scanning start signal STVP2, to the gate driver 400. The scanning start signal STVP1 and the scanning start signal STVP2 each have a start voltage pulse which is repeated in one frame period. There is an interval of half a frame between the start voltage pulses of the scanning start signal STVP1 and the scanning start signal STVP2. The signal controller 600 may temporarily store an RGB image signal input from a graphic controller (not shown) in the frame memory 601. The signal controller 600 may change an order of data voltages so that a data voltage for a first group of pixels is followed by a data voltage for a second group of pixels and may supply the data voltages to the data driver 500. The data voltage for the first group of pixels refers to a data voltage to be applied to pixels connected to the first group of gate lines and the data voltage for the second group of pixels refers to a data voltage to be applied to pixels connected to the second group of gate lines.

A display operation of the liquid crystal display will be described in more detail.

The signal controller 600 is configured to receive RGB image signals R, G, and B and an input control signal to control a display from an external graphic controller (not shown). The input control signal may include at least one of a vertical synchronization signal $V_{sync}$, a horizontal synchronizing signal $H_{sync}$, a main clock signal MCLK, a data enable signal DE, and the like. The signal controller 600 may generate a gate control signal CONT1, a data control signal CONT2, and the like based on the input control signal. The signal controller 600 may process the image signals R, G, and B in accordance with an operating condition of the liquid crystal panel assembly 300. Then, the signal controller 600 may transmit the gate control signal CONT1 to the gate driver 400, and the data control signal CONT2 and the processed image signals R', G', and B' to the data driver 500. The processing of the image signals R, G, and B in accordance with the operating condition of the liquid crystal panel assembly 300 may also include an operation of temporarily storing the RGB image signal input from the graphic controller (not shown) in the frame memory 601 and then, changing the order of the data voltages so that the data voltage for the first group of pixels is followed by the data voltage for the second group of pixels.

The gate control signal CONT1 may include at least one of the scanning start signal STVP1 and the scanning start signal STVP2 to control a gate-on pulse, which begins a gate-on voltage period, a gate clock signal CK1 and a gate clock signal CK2 to control an output time of the gate-on pulse, an output enable signal OE to restrict a width of the gate-on pulse, and the like.

The data control signal CONT2 may include at least one of a horizontal synchronization start signal STH to control the start of image data R', G' and B', a load signal LOAD to control the application of the data voltage to data lines $D_1$-$D_m$, an inversion signal RVS to invert a polarity of the data voltage with respect to the common voltage $V_{com}$ (hereinafter the "polarity of the data voltage with respect to the common voltage" shall be referred to as "polarity of the data voltage"), a data clock signal HCLK, and the like.

The gate driver 400 may apply a gate-on voltage $V_{on}$ to the gate lines $G_1$-$G_n$ according to the gate control signal CONT1 from the signal controller 600 to turn on the switching element Q connected to the gate lines $G_1$-$G_n$.

The gate driver 400 may classify the gate lines $G_1$-$G_n$ into first group of gate lines $G_1$, $G_3$, $G_4$, $G_7$, $G_8$ . . . and second group of gate lines $G_2$, $G_5$, $G_6$, $G_9$, $G_{10}$ . . . . The gate driver 400 may sequentially apply a gate-on voltage $V_{on}$ to the first group of gate lines $G_1$, $G_3$, $G_4$, $G_7$, $G_8$ . . . during the first half of a frame, and sequentially apply a gate-on voltage $V_{on}$ to the second group of gate lines $G_2$, $G_5$, $G_6$, $G_9$, $G_{10}$ . . . during the second half of the frame. In an exemplary embodiment, except for the first gate line $G_1$ and the second gate line $G_2$, every two gate lines arranged sequentially are bound together and classified in the same group. However, the classification of the gate line groups may be modified in various ways. For example, odd numbered gate lines may be classified as a first group and even numbered gate lines may be classified as a second group, or every two gate lines from the first gate line onwards may be bound together and classified alternately as a first group and a second group.

The data driver 500 may sequentially receive image data R', G', and B' corresponding to pixels of one row according to the data control signal CONT2 from the signal controller 600 and may selects a gray voltage corresponding to each image data R', G', and B' from among gray voltage generated by the gray voltage generator 800 to convert the image data R', G', and B' into data voltages.

The data driver 500 generates two kinds of data voltages, data voltage Data 1 and data voltage Data 2, which swing between positive and negative values while having opposite polarities with respect to the common voltage $V_{com}$.

The data voltage Data 1 may be applied to the odd numbered data lines and the data voltage Data 2 may be applied to the even numbered data lines. The data voltage Data 1 and the data voltage Data 2 applied to each of the data lines $D_1$-$D_m$ may be selected so that polarity of the data voltage Data 1 and the data voltage Data 2 may change every half frame. The data voltage Data 1 and the data voltage Data 2 applied to two adjacent data lines at the same time may be selected so that polarities of the data voltage Data 1 and data voltage Data 2 are opposite to each other.

The data driver 500 may supply the data voltage Data 1 and the data voltage Data 2 to corresponding data lines $D_1$-$D_m$ for a period of time if a gate-on voltage $V_{on}$ is applied to one of the gate lines $G_1$-$G_n$ to turn on the switching element Q of one row connected thereto. The data voltage Data 1 and the data voltage Data 2 supplied to the data lines $D_1$-$D_m$ are applied to a corresponding pixel via the switching element Q, which has been turned on. The period of time when the switching element of one row is turned on is generally referred to as a "1H" or "1 horizontal period."

In an exemplary embodiment, the data voltage Data 1 and data voltage Data 2 applied to each of the data lines $D_1$-$D_m$ may be selected so that the polarity of the data voltage Data 1 and data voltage Data 2 is changed every half frame, but the polarities of the data voltage Data 1 and data voltage Data 2 may be changed at a different period. For example, the data voltage may be inverted after a period of more than 3H and less than one frame.

A gate-on voltage $V_{on}$ may be sequentially applied to the first group of gate lines $G_1$, $G_3$, $G_4$, $G_7$, $G_8$ . . . during the first half of a frame and a gate-on voltage $V_{on}$ may be sequentially applied to the second group of gate lines $G_2$, $G_5$, $G_6$, $G_9$, $G_{10}$ . . . during the second half of the frame, thereby applying the data voltage to all the pixels. When the frame ends, a new frame starts and an inversion signal RVS applied to the data driver 500 may be controlled so that a polarity of the data voltage applied to each pixel PX is opposite to a polarity applied to each pixel PX in the previous frame.

A structure and an operation of a display device according to an exemplary embodiment of the present invention will be described in more detail with reference to FIG. 3, FIG. 4, FIG. 5, and FIG. 6.

Figure 3:
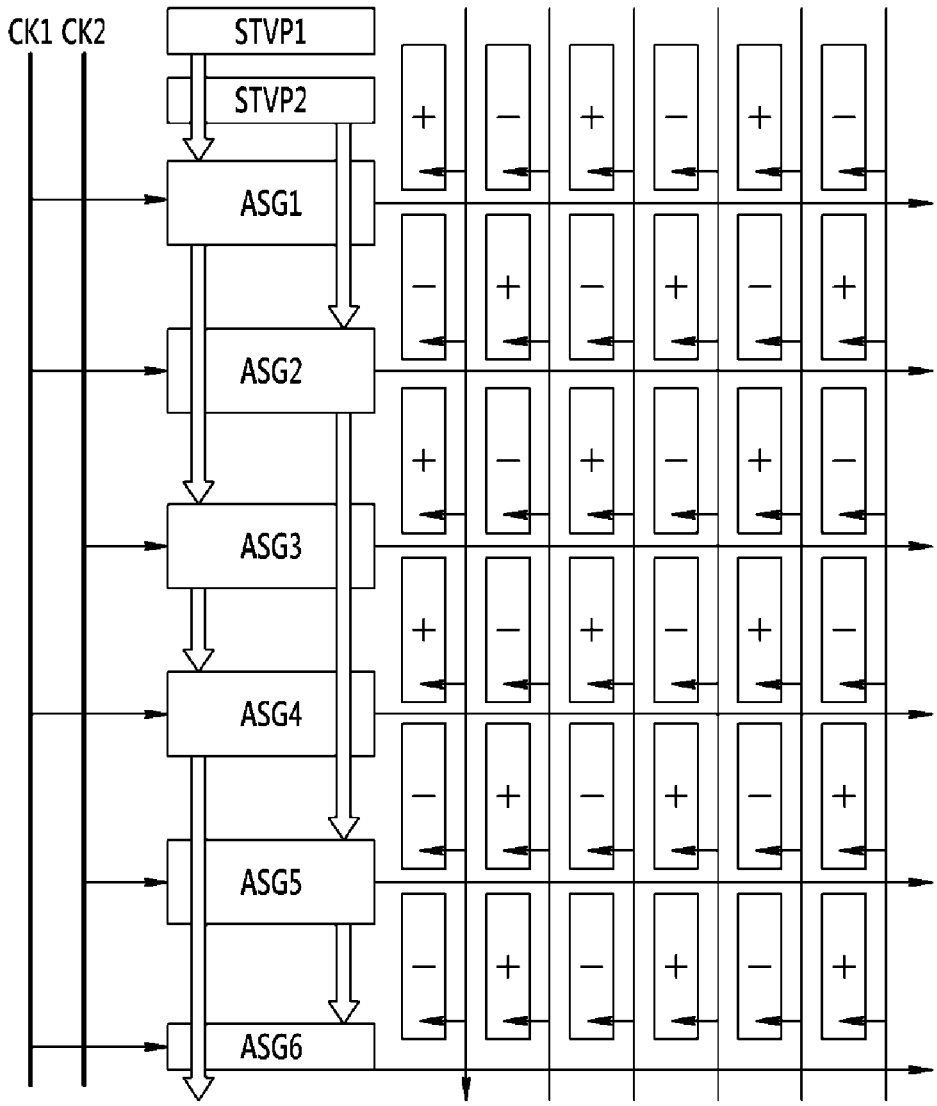
FIG. 3 is a block diagram of a gate driver according to an exemplary embodiment of the present invention.
Figure 4:
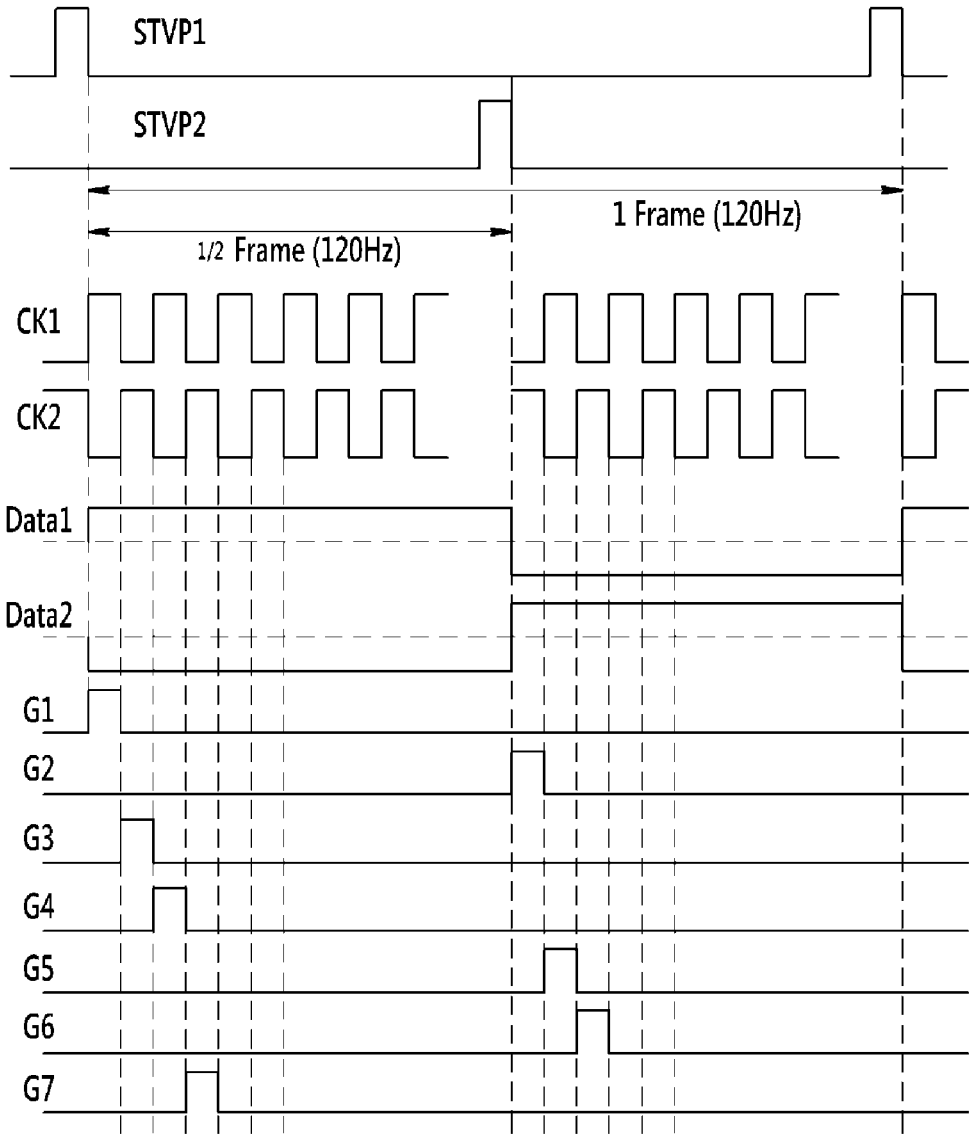
FIG. 4 is a waveform diagram of various signals according to an exemplary embodiment of the present invention.
Figure 5:
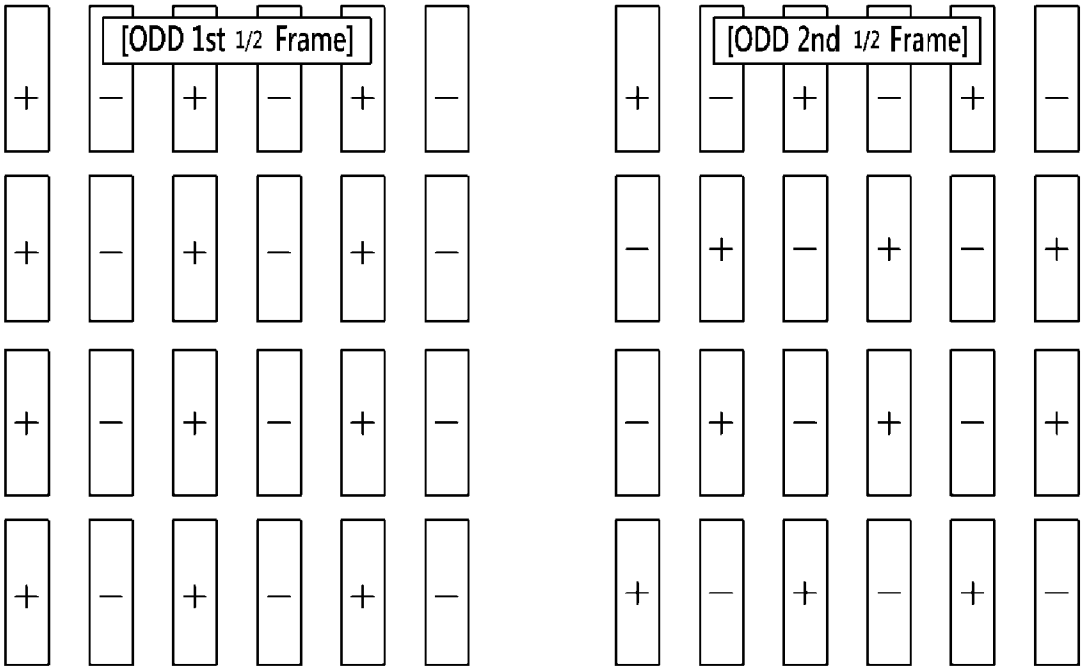
FIG. 5 is a conceptual view showing polarities of pixel voltages in an odd numbered frame according to an exemplary embodiment of the present invention.
Figure 6:
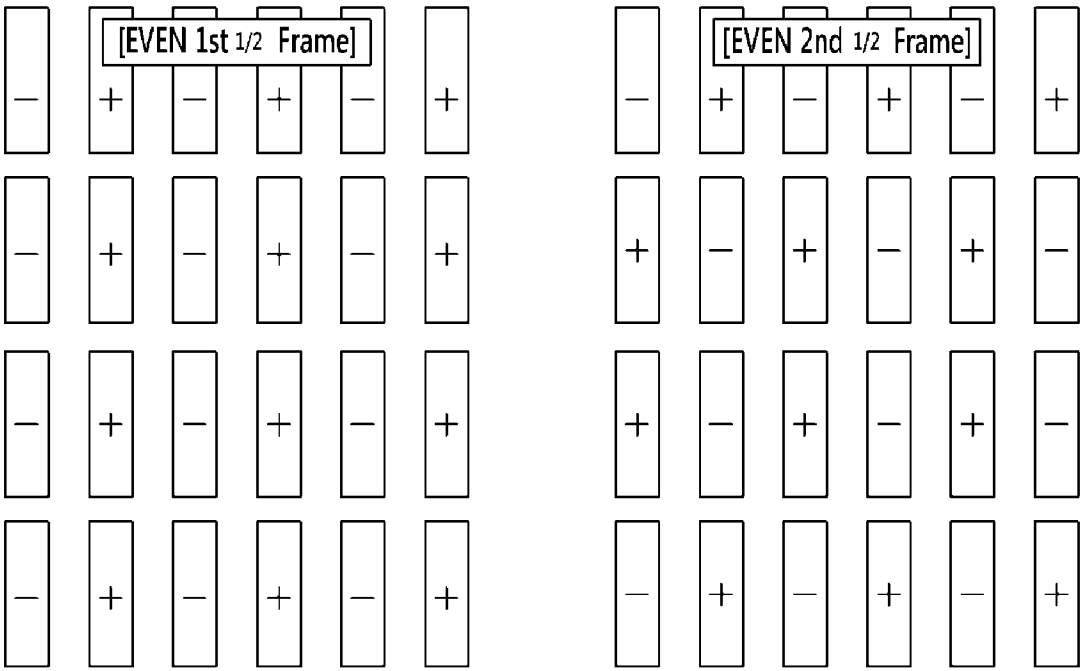
FIG. 6 is a conceptual view showing polarities of pixel voltages in an even numbered frame according to an exemplary embodiment of the present invention.

FIG. 3 is a block diagram of a gate driver according to an exemplary embodiment of the present invention. FIG. 4 is a waveform diagram of various signals according to an exemplary embodiment of the present invention. FIG. 5 is a conceptual view showing polarities of pixel voltages in an odd numbered frame according to an exemplary embodiment of the present invention. FIG. 6 is a conceptual view showing polarities of pixel voltages in an even numbered frame according to an exemplary embodiment of the present invention.

Referring to FIG. 3, the gate driver 400 includes a plurality of shift registers ASG1, ASG2 . . . which are arranged in a line.

The shift registers ASG1, ASG2 . . . may be formed and integrated with the same substrate as the switching elements of the pixels PX. In other words, the shift registers ASG1, ASG2 . . . may be formed at the same time the liquid crystal panel assembly 300 is formed instead of providing a separate gate driving IC and mounting the gate driving IC on the substrate.

The gate driver 400 starts outputting a gate-on voltage $V_{on}$ according to the scanning start signal STVP1 and the scanning start signal STVP2 from the signal controller 600 and sequentially applies the gate-on voltages $V_{on}$ to the gate lines $G_1$-$G_n$ arranged in a line.

A first shift register ASG1 of the gate driver 400 is synchronized with the scanning start signal STVP1 and the clock signal CK1 to start outputting a gate-on voltage $V_{on}$. An output voltage of the first shift register ASG1 is supplied to a third shift register ASG3 after skipping a second shift register ASG2. The third shift register ASG3 is synchronized with the clock signal CK2 and the output voltage of the first shift register ASG1 to output a gate-on voltage $V_{on}$. An output voltage of the third shift register ASG3 is supplied to a fourth shift register ASG4. The fourth shift register ASG4 is synchronized with the clock signal CK1 and the output voltage of the third shift register ASG3 to output a gate-on voltage $V_{on}$. An output voltage of the fourth shift register ASG4 is supplied to a seventh shift register ASG7 after skipping a fifth shift register ASG5 and a sixth shift register ASG6. The seventh shift register ASG7 is synchronized with the clock signal CK2 and the output voltage of the fourth shift register ASG4 to output a gate-on voltage $V_{on}$.

The second shift register ASG2 is synchronized with the scanning start signal STVP2 and the clock signal CK1 to start outputting a gate-on voltage $V_{on}$. The output voltage of the second shift register ASG2 is supplied to the fifth shift register ASG5 after skipping the third shift register ASG3 and the fourth shift register ASG4. The fifth shift register ASG5 is synchronized with the clock signal CK2 and the output voltage of the second shift register ASG2 to output a gate-on voltage $V_{on}$. An output voltage of the fifth shift register ASG5 is supplied to a sixth shift register ASG6. The sixth shift register ASG6 is synchronized with the clock signal CK1 and the output voltage of the fifth shift register ASG5 to output a gate-on voltage $V_{on}$. An output voltage of the sixth shift register ASG6 is supplied to a ninth shift register ASG9 after skipping the seventh shift register ASG7 and the eighth shift register ASG8. The ninth shift register ASG9 is synchronized with the clock signal CK2 and the output voltage of the sixth shift register ASG6 to output a gate-on voltage $V_{on}$.

As described above, the first shift register ASG1 is synchronized with a start voltage pulse of the scanning start signal STVP1 to start outputting the gate-on voltage $V_{on}$ and the second shift register ASG2 is synchronized with a start voltage pulse of the scanning start signal STVP2 to start outputting the gate-on voltage $V_{on}$. Therefore, the first shift register ASG1 and a group (hereinafter, referred to as a "first shift register group") including the shift registers ASG3, ASG4, ASG7, ASG8, . . . which are connected to the first shift register ASG1 to receive output signals, successively output the gate-on voltages $V_{on}$ with the scanning start signal STVP1 as a starting point. The second shift register ASG2 and a group (hereinafter, referred to as a "second shift register group") including the shift registers ASG5, ASG6, ASG9, ASG10, . . . which are connected to the second shift register ASG2 to receive output signals, successively output the gate-on voltages $V_{on}$ with the scanning start signal STVP2 as a starting point. Therefore, it may be possible to control the time for outputting the gate-on voltages $V_{on}$ of the first shift register group and the second shift register group by adjusting the time for applying the two scanning start signals, scanning start signal STVP1 and scanning start signal STVP2. In an exemplary embodiment, after the outputting of the gate-on voltages $V_{on}$ of the first shift register group is completed, the outputting of the gate-on voltages $V_{on}$ of the second shift register group starts.

An output voltage of the last shift register of the first shift register group may be supplied to the second shift register ASG2 as a scanning start signal instead of the scanning start signal STVP2.

The data driver 500 may output a data voltage to be charged in a pixel connected to each gate line in accordance with the gate-on voltages $V_{on}$ output by the gate driver 400. The data driver 500 generates two kinds of data voltages, data voltage Data 1 and data voltage Data 2, which swing between positive and negative values while having opposite polarities with respect to the common voltage $V_{com}$. The data voltage Data 1 may be applied to the odd numbered data lines and the data voltage Data 2 may be applied to the even numbered data lines. The data voltage Data 1 and the data voltage Data 2 applied to each of the data lines $D_1$-$D_m$ may be selected so that polarity of the data voltage Data 1 and the data voltage Data 2 may change every half frame. The data voltage Data 1 and data voltage Data 2 applied to two adjacent data lines at the same time may be selected so that polarities of the data voltage Data 1 and data voltage Data 2 are opposite to each other.

As shown in FIG. 3 and described above, when the gate-on voltage $V_{on}$, the data voltage Data 1, and data voltage Data 2 are applied, a 1+2×1 dot inversion type driving scheme (driving in which only the uppermost two rows correspond to 1dot inversion and the other rows correspond to 2dot inversion in a column direction) may be implemented.

The driving of the liquid crystal display will be described in detail with reference to FIG. 4.

FIG. 4 is a waveform diagram of various signals according to an exemplary embodiment of the present invention.

FIG. 4 shows waveforms of the scanning start signal STVP1, the scanning start signal STVP2, the clock signal CK1, and the clock signal CK2 applied to the gate driver 400, waveforms showing polarities of the data voltage Data 1 and the data voltage Data 2, and waveforms of gate signals G1, G2, G3 . . . .

As shown in FIG. 4, the signal controller 600 first inputs the scanning start signal STVP1, the clock signal CK1, and the clock signal CK2 to the gate driver 400, so that the gate-on voltages $V_{on}$ are sequentially applied to the first group of gate lines $G_1$, $G_3$, $G_4$, $G_7$, $G_8$ . . . . After the lapse of half a frame, the signal controller 600 inputs the scanning start signal STVP2 to the gate driver 400 together with the clock signal CK1 and the clock signal CK2, so that the gate-on voltages $V_{on}$ are sequentially applied to the second group of gate lines $G_2$, $G_5$, $G_6$, $G_9$, $G_{10}$ . . . . As described above, the gate-on voltages $V_{on}$ are sequentially applied to the second group of gate lines $G_2$, $G_5$, $G_6$, $G_9$, $G_{10}$ . . . , after the gate-on voltages $V_{on}$ are sequentially applied to the first group of gate lines $G_1$, $G_3$, $G_4$, $G_7$, $G_8$ . . . by applying the two scanning start signals, scanning start signal STVP1 and scanning start signal STVP2 at an interval of half a frame.

The data driver 500 applies the data voltage Data 1 and data voltage Data 2 to pixels through the data lines $D_1$-$D_m$, in which the data voltage Data 1 is applied to odd numbered data lines $D_1$, $D_3$ . . . and the data voltage Data 2 is applied to even numbered data lines $D_2$, $D_4$ . . . . The polarities of the data voltage Data 1 and data voltage Data 2 are changed every half frame and are opposite to each other.

If the liquid crystal display is driven it may be possible to reduce power consumption compared with a dot inversion or 2dot inversion structure of the related art in which a change in polarity may occur every one or two horizontal periods, because the polarities of the data voltage Data 1 and data voltage Data 2 are changed every half frame. It may be possible to prevent image quality degradation by, for example, a vertical line stain which may occur in column inversion driving because a 1+2×1 dot inversion type driving scheme may be implemented. The effects will be described with reference to FIG. 5 and FIG. 6.

FIG. 5 is a conceptual view showing polarities of pixel voltages in an odd numbered frame according to an exemplary embodiment of the present invention. FIG. 6 is a conceptual view showing polarities of pixel voltages in an even numbered frame according to an exemplary embodiment of the present invention.

Referring to the left side of FIG. 5, pixels connected to the first group of gate lines (the upper most pixel row and the lower most pixel row) receive the data voltages inverted from the previous frame during the first half of the odd numbered frames among the continuous frames. Thus, pixels in the same pixel columns are charged with the same polarities to be in a column inversion type driving scheme. Referring to the right side of FIG. 5, during the subsequent second half of the odd numbered frames, pixels connected to the second group of gate lines (the two middle pixel rows) receive data voltages inverted from the previous frame, and a 2dot inversion type driving scheme is implemented.

Referring to the left side of FIG. 6, during the first half of the subsequent even numbered frames, pixels connected to the first group of gate lines (the upper most pixel row and the lower most pixel row) receive data voltage inverted from the previous frame. Thus, pixels in the same pixel columns are charged with the same polarities to be in a column inversion type driving scheme. Referring to the right side of FIG. 6, during the subsequent second half of the even numbered frames, pixels connected to the second group of gate lines (the two middle pixel rows) receive data voltages inverted from the previous frame, and a 2dot inversion type driving scheme is implemented.

As described above, according to an exemplary embodiment of the present invention, during the first half of the frames, a voltage arrangement for a column inversion type driving scheme is implemented and during the second half of the frames, a voltage arrangement for a 2dot inversion type driving scheme is implemented. Accordingly, luminance deviation among frames may not be observed by a user, because two types of inversion driving scheme are mixed together and displayed to the user.

As described above, except for the first gate line $G_1$ and the second gate line $G_2$, each two successively arranged gate lines are bound together and classified in the same gate line group. However, the classification of the gate line groups may be modified in various ways without departing from the scope of present invention.

Figure 7:
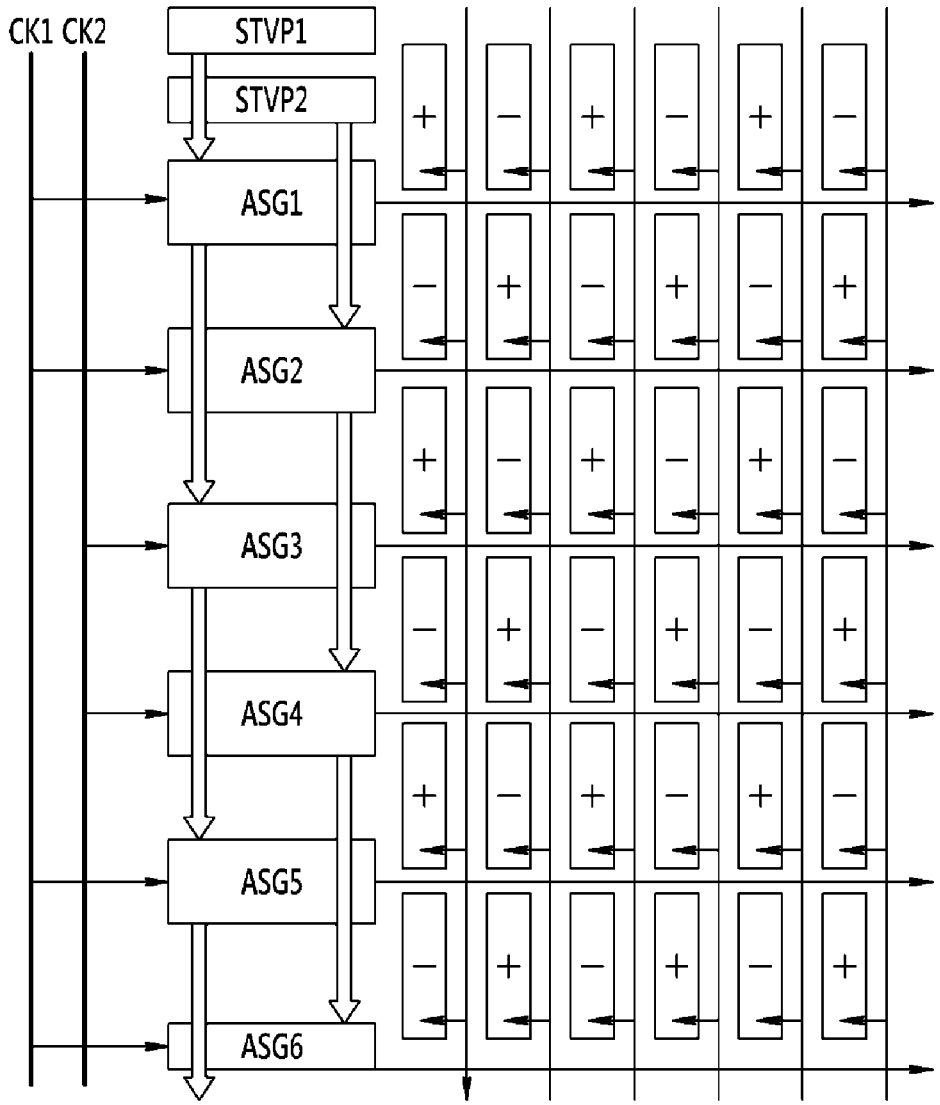
FIG. 7 is a block diagram of a gate driver according to an exemplary embodiment of the present invention.
Figure 8:
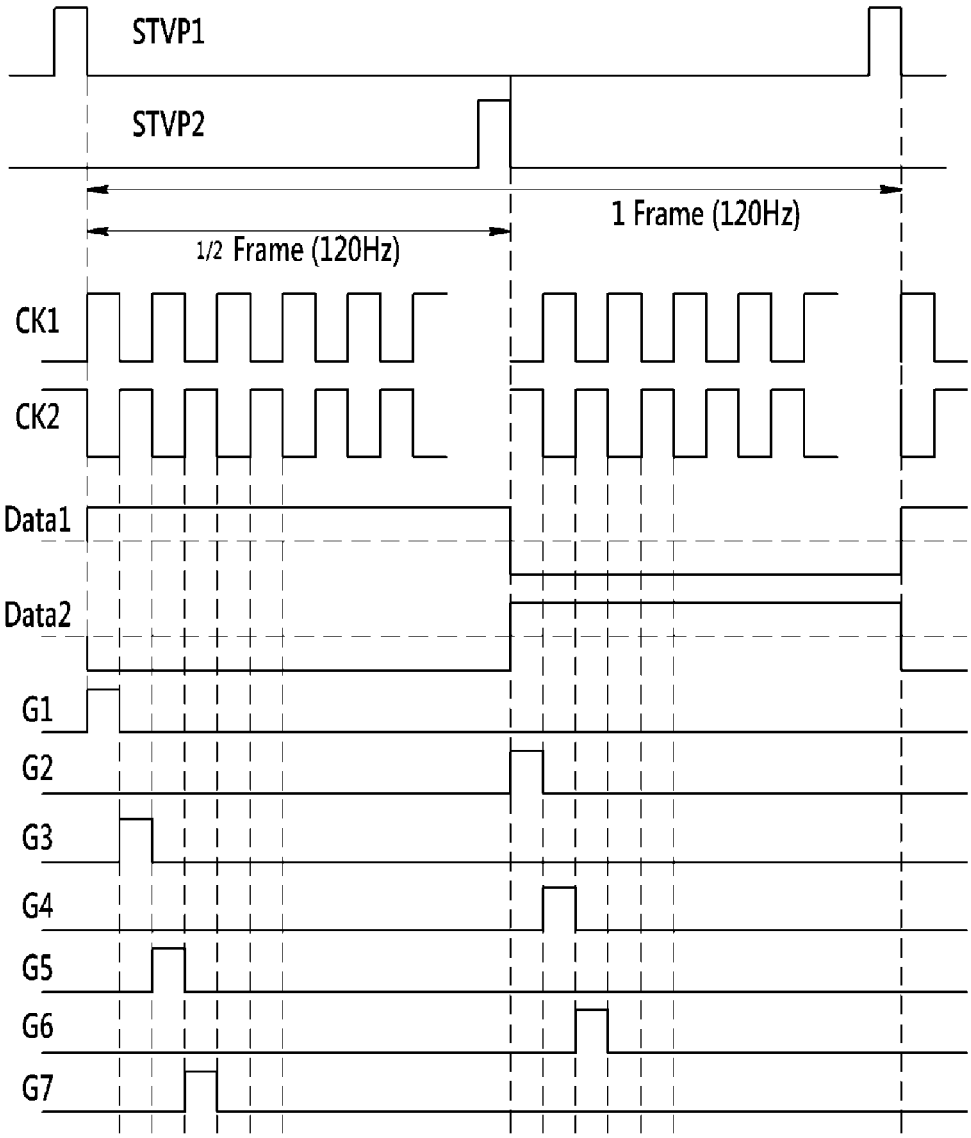
FIG. 8 is a waveform diagram of various signals according to an exemplary embodiment of the present invention.

FIG. 7 is a block diagram of a gate driver according to an exemplary embodiment of the present invention. FIG. 8 is a waveform diagram of various signals according to an exemplary embodiment of the present invention.

The structure of the display device in FIG. 7 and FIG. 8 is similar to the exemplary embodiment shown in FIG. 1, FIG. 2, FIG. 3, and FIG. 4. Therefore, descriptions of similar elements have been omitted for clarity.

In FIG. 7, odd numbered gate lines are classified as a first group of gate lines and even numbered gate lines are classified as a second group of gate lines.

Referring to FIG. 7 and FIG. 8, a first shift register ASG1 of the gate driver 400 is synchronized with a scanning start signal STVP1 and the clock signal CK1 to output a gate-on voltage $V_{on}$. The output voltage of the first shift register ASG1 is supplied to a third shift register ASG3 after skipping a second shift register ASG2. The third shift register ASG3 is synchronized with the clock signal CK2 and the output voltage of the first shift register ASG1 to output a gate-on voltage $V_{on}$ and the output voltage is supplied to a fifth shift register ASG5.

The second shift register ASG2 is synchronized with the scanning start signal STVP2 and the clock signal CK1 to start outputting a gate-on voltage $V_{on}$. The output voltage of the second shift register ASG2 is supplied to a fourth shift register ASG4 after skipping the third shift register ASG3. The fourth shift register ASG4 is synchronized with the clock signal CK2 and the output voltage of the second shift register ASG2 to output a gate-on voltage $V_{on}$ and the output voltage is supplied to a sixth shift register ASG6.

The first shift register ASG1 is synchronized with a start voltage pulse of the scanning start signal STVP1 to start outputting the gate-on voltage $V_{on}$ and the second shift register ASG2 is synchronized with a start voltage pulse of the scanning start signal STVP2 to start outputting the gate-on voltage $V_{on}$. Therefore, the first shift register ASG1 and a group including the odd numbered shift registers ASG3, ASG5, ASG7, ASG9, . . . successively output the gate-on voltages $V_{on}$ with the scanning start signal STVP1 as a starting point and the second shift register ASG2 and a group including the even numbered shift registers ASG4, ASG6, ASG8, ASG10, . . . successively output the gate-on voltages $V_{on}$ with the scanning start signal STVP2 as a starting point. As a result, it may be possible to control the time for outputting the gate-on voltages $V_{on}$ of the odd numbered shift register group and the even numbered shift register group by adjusting the time for applying the two scanning start signals, scanning start signal STVP1 and scanning start signal STVP2. In an exemplary embodiment, after the outputting of the gate-on voltages $V_{on}$ of the odd numbered shift register group is completed, the outputting of the gate-on voltages $V_{on}$ of the even numbered shift register group starts.

An output voltage of the last shift register of the odd numbered shift register group may be supplied to the second shift register ASG2 as a scanning start signal instead of the scanning start signal STVP2.

The data driver 500 may output a data voltage to be charged in a pixel connected to each gate line in accordance with the gate-on voltage $V_{on}$ output by the gate driver 400. The data driver 500 generates two kinds of data voltages, data voltage Data 1 and data voltage Data 2, which swing between positive and negative values while having opposite polarities with respect to the common voltage $V_{com}$. The data voltage Data 1 may be applied to the odd numbered data lines and the data voltage Data 2 may be applied to the even numbered data lines. The data voltage Data 1 and data voltage Data 2 applied to each of the data lines $D_1$-$D_m$ may be selected so that polarity of the data voltage Data 1 and the data voltage Data 2 is changed every half frame. Data voltage Data 1 and data voltage Data 2 applied to two adjacent data lines at the same time may be selected so that polarities of the data voltage Data 1 and data voltage Data 2 are opposite to each other.

As shown in FIG. 7, when the gate-on voltage $V_{on}$, the data voltage Data 1, and data voltage Data 2 are applied, a 1dot inversion type driving scheme may be implemented.

The driving of the liquid crystal display will be described in detail with reference to FIG. 8.

FIG. 8 is a waveform diagram of various signals according to an exemplary embodiment of the present invention.

FIG. 8 shows waveforms of the scanning start signal STVP1, the scanning start signal STVP2, the clock signal CK1, and the clock signal CK2 applied to the gate driver 400, waveforms showing polarities of the data voltage Data 1 and data voltage Data 2, and waveforms of gate signals G1, G2, G3 . . . .

As shown in FIG. 8, the signal controller 600 first inputs the scanning start signal STVP1, the clock signal CK1 and the clock signal CK2 to the gate driver 400, so that the gate-on voltages $V_{on}$ are sequentially applied to a first group of gate lines $G_1$, $G_3$, $G_5$, $G_7$, $G_9$ . . . including the odd numbered gate lines. After the lapse of half a frame, the signal controller 600 inputs the scanning start signal STVP2 to the gate driver 400 together with the clock signal CK1 and the clock signal CK2, so that the gate-on voltages $V_{on}$ are sequentially applied to a second group of gate lines $G_2$, $G_4$, $G_6$, $G_8$, $G_{10}$ . . . including the even numbered gate lines. As described above, the gate-on voltages $V_{on}$ are sequentially applied to the second group of gate lines $G_2$, $G_4$, $G_6$, $G_8$, $G_{10}$ . . . , after the gate-on voltages $V_{on}$ are sequentially applied to the first group of gate lines $G_1$, $G_3$, $G_5$, $G_7$, $G_9$ . . . by applying the two scanning start signals, scanning start signal STVP1 and scanning start signal STVP2, at an interval of half a frame.

The data driver 500 applies the data voltage Data 1 and data voltage Data 2 to pixels through the data lines $D_1$-$D_m$, in which the data voltage Data 1 is applied to odd numbered data lines $D_1$, $D_3$ . . . and the data voltage Data 2 is applied to even numbered data lines $D_2$, $D_4$ . . . . The polarities of the data voltage Data 1 and data voltage Data 2 are changed every half frame and are opposite to each other.

If the liquid crystal display is driven, it may be possible to reduce power consumption compared with a dot inversion or 2dot inversion structure of the related art in which a change in polarity may occur every one or two horizontal periods, because the polarities of the data voltage Data 1 and data voltage Data 2 are changed every half frame. It may be possible to prevent image quality degradation by, for example, a vertical line stain which may occur in column inversion driving because a 1dot inversion type driving scheme may be implemented.

According to the exemplary embodiments of the present invention, it may be possible to reduce power consumption of a display device without causing image quality degradation by dividing gate lines into two groups, sequentially applying the gate-on voltages to each of the groups, and inverting and applying a data voltage for every period longer than three horizontal periods and shorter than one frame (for example, a half frame).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a display device comprising:

in a first portion of a first frame, applying a first polarity data voltage to pixels disposed in odd columns and a second polarity data voltage to pixels disposed in even columns;

in a second portion of the first frame, alternately applying the first polarity data voltage and the second polarity data voltage to pixels in the same row of pixels;

in a first portion of a second frame, applying the second polarity data voltage to the pixels disposed in the odd columns and the first polarity data voltage to the pixels disposed in the even columns; and in a second portion of the second frame, alternately applying the first polarity data voltage and the second polarity data voltage to pixels in the same row of pixels, wherein the polarities of the data voltages applied in the second portion of the first frame are inverted from the polarities of the data voltages applied in the second portion of the second frame, wherein both the first polarity data voltage and the second polarity data voltage are applied to pixels in the same column in the second portion of the first frame, wherein the same polarity data voltage is applied to all pixels in the same column in the first portion of the first frame, and wherein the second frame immediately follows the first frame.

2. The method of claim 1, wherein both the first polarity data voltage and the second polarity data voltage are applied to pixels in the same column in the second portion of the second frame.

* * * * *